US008035633B2

(12) United States Patent
Park

(10) Patent No.: US 8,035,633 B2
(45) Date of Patent: Oct. 11, 2011

(54) ORGANIC ELECTRO-LUMINESCENCE DISPLAY AND DRIVING METHOD THEREOF

(75) Inventor: Sung-cheon Park, Suwon-si (KR)

(73) Assignee: Samsung Mobile Display Co., Ltd (KR)

( * ) Notice: Subject to any disclaimer, the term of this patent is extended or adjusted under 35 U.S.C. 154(b) by 1077 days.

(21) Appl. No.: 11/897,366

(22) Filed: Aug. 29, 2007

(65) Prior Publication Data

US 2008/0111811 A1 May 15, 2008

(30) Foreign Application Priority Data

Nov. 14, 2006 (KR) ..... 10-2006-0112224

(51) Int. Cl.
*G09G 3/30* (2006.01)

(52) U.S. Cl. ..... 345/211; 345/36; 345/76; 345/92

(58) Field of Classification Search ..... 345/76–100, 345/36, 211
See application file for complete search history.

(56) References Cited

U.S. PATENT DOCUMENTS

2003/0067289 A1* 4/2003 Morita ..... 323/282
2004/0222951 A1* 11/2004 Lee et al. ..... 345/77
2006/0221007 A1* 10/2006 Kim ..... 345/76
2006/0244691 A1* 11/2006 Lee ..... 345/76
2006/0248420 A1* 11/2006 Jeong ..... 714/727
2006/0262059 A1* 11/2006 Hashimoto et al. ..... 345/89

FOREIGN PATENT DOCUMENTS

KR 10-2006-0065083 A 6/2006

OTHER PUBLICATIONS

Notice of Allowance for 9-5-2008-001622128.

* cited by examiner

*Primary Examiner* — Alexander Eisen
*Assistant Examiner* — Viet Pham
(74) *Attorney, Agent, or Firm* — Knobbe Martens Olson & Bear LLP

(57) ABSTRACT

An organic electro-luminescence display is disclosed. The display includes a pixel unit configured to display at least a portion of an image, a first regulator configured to generate first and second power voltages and to transmit the first and second power voltages to the pixel power source line, a second regulator configured to generate a predetermined voltage and to transmit the predetermined voltage to a driver driving unit, and a power generating unit. The power generating unit is configured to generate another predetermined voltage, to transmit the other predetermined voltage to the signal generator, to generate a third power voltage, to transmit the third power voltage to the pixel unit, and to generate a fourth power voltage. The display also includes a switching unit configured to transmit the third and fourth power voltages to the pixel power source line when the first and second power voltages are off.

28 Claims, 3 Drawing Sheets

4181562

082407

ORGANIC ELECTRO-LUMINESCENCE DISPLAY AND DRIVING METHOD THEREOF

CROSS-REFERENCE TO RELATED APPLICATIONS

This application claims the benefit of Korean Patent Application No. 2006-0112224, filed on Nov. 14, 2006, in the Korean Intellectual Property Office, the disclosure of which is incorporated herein by reference.

BACKGROUND OF THE INVENTION

1. Field of the Invention

The present invention relates to an organic electro-luminescence display and a driving method thereof, and more particularly to an organic electro-luminescence display and a driving method thereof, capable of reducing power consumption in a partial driving thereof.

2. Description of the Related Art

Recently, various flat panel display devices with small weight and volume compared with cathode ray tubes have been developed. The flat panel display devices have a plurality of pixels on a substrate in a matrix to form a pixel unit, and scan lines and data lines to each pixel to selectively apply data signals to the pixels for displaying.

The flat panel display device may be a passive matrix type display device or an active matrix type display device in accordance with a driving scheme for the pixels. The active matrix type has mainly been used in view of better resolution, contrast and an operation speed.

Such a flat panel display device has been used as a display device of a portable information terminal such as a personal computer, a mobile telephone, a PDA, etc., or a monitor for various information equipment. An LCD using a liquid crystal panel, an organic electro-luminescence display using organic light-emitting element and a PDP using a plasma panel, etc., have been known. In particular, the organic electro-luminescence display, is excellent in view of emission efficiency, brightness, view angle and has a rapid response speed.

In the case when an organic electro-luminescence display is partially driven, that is, when only a portion of the display is used to emit light for an image and the rest of the display is black, and in the case when the image is displayed at low brightness, if the electro-luminescence display is in a standby mode, the electro-luminescence display has a disadvantage of relatively larger power consumption compared with a LCD. The LCD can display a partial driving by turning off a part of backlight units, and can display a standby mode state by turning on the entire display, making it possible to reduce power consumption in the backlight unit. In contrast, since each pixel in the organic electro-luminescence display displays an image corresponding to data signals, and a first power voltage and a second power voltage, a display of a gray scale corresponds to the data signals and the first power voltage. Therefore, even when the pixel displays black, the organic electro-luminescence display should receive the first power voltage and the data signals displaying black.

The organic electro-luminescence display generates the first power voltage and the second power voltage by using a switching regulator, and the efficiency of the switching regulator drops when load is low because of its characteristics, and the organic electro-luminescence display has to consume several tens of NW of power in order to operate the switching regulator.

Therefore, when the organic electro-luminescence display is used in a portable information terminal, etc., such as a cellular phone, etc., the power consumption becomes large enough to significantly reduce battery life.

SUMMARY OF CERTAIN INVENTIVE ASPECTS

Embodiments which reduce power consumption, and therefore prolong battery life are presented.

One aspect is an organic electro-luminescence display including a pixel unit including a pixel connected to a data line, a scan line and a pixel power source line, the pixel unit configured to display at least a portion of an image The display also includes a first regulator configured to receive a power signal from an external source and to generate a first power voltage and a second power voltage based at least in part on the received power signal, the second power voltage having electric potential lower than the first power voltage, the first regulator further configured to transmit the first and second power voltages to the pixel power source line. The display also includes a second regulator configured to receive another power signal from another external source, to generate a predetermined voltage based at least in part on the received other power signal, and to transmit the predetermined voltage to a driver driving unit. The driver driving unit includes a signal generator configured to generate a data signal and a scan signal, and to transmit the data signal and the scan signal to the data line and the scan line, respectively, and a power generating unit configured to generate another predetermined voltage, to transmit the other predetermined voltage to the signal generator, to generate a third power voltage, to transmit the third power voltage to the pixel unit, and to generate a fourth power voltage, the fourth power voltage having electrical potential lower than the third power voltage. The display also includes a switching unit configured to transmit the third power voltage and the fourth power voltage to the pixel power source line when the first power voltage and the second power voltages are off.

Another aspect is an organic electro-luminescence display including a pixel unit configured to display an image with at least one pixel connected to a data line, a scan line and a pixel power source line. The display also includes a power supply configured to generate a first power voltage and a second power voltage and to transmit the first and second power voltages to the pixel through the pixel power source line, a driver driving unit including a signal generator configured to generate a data signal and a scan signal, and a power generating unit configured to generate an operating voltage based on a received driving voltage. The signal generator is connected to the data line and the scan line to transmit the data signal and the scan signal to the pixel, and the power generator is configured to generate a third power voltage and a fourth power voltage and to transmit the third and fourth power voltages to the pixel through the pixel power source line, where the third power voltage and the fourth power voltage are transmitted to the pixel when the power supplier is stopped.

Another aspect is a method of driving an organic electrode luminescence display configured to display an image with at least one pixel connected to a data line, a scan line and a power source line. The method includes generating a first power voltage and a second power voltage, transmitting the first and second power voltages to the pixel through the pixel power source line to display an image using the first power voltage and the second power voltage, ceasing to generate the first power voltage and the second power voltage in response to a control signal, and transmitting a third power voltage and a fourth power voltage according to the control signal to the pixel through the power source line to display an image using the third power voltage and the fourth power voltage.

BRIEF DESCRIPTION OF THE DRAWINGS

Advantages of the presented embodiments will become apparent and more readily appreciated from the following description of the embodiments, taken in conjunction with the accompanying drawings of which.

DETAILED DESCRIPTION OF CERTAIN INVENTIVE EMBODIMENTS

Hereinafter, embodiments will be described in a more detailed manner with reference to the accompanying drawings.

Figure 1:
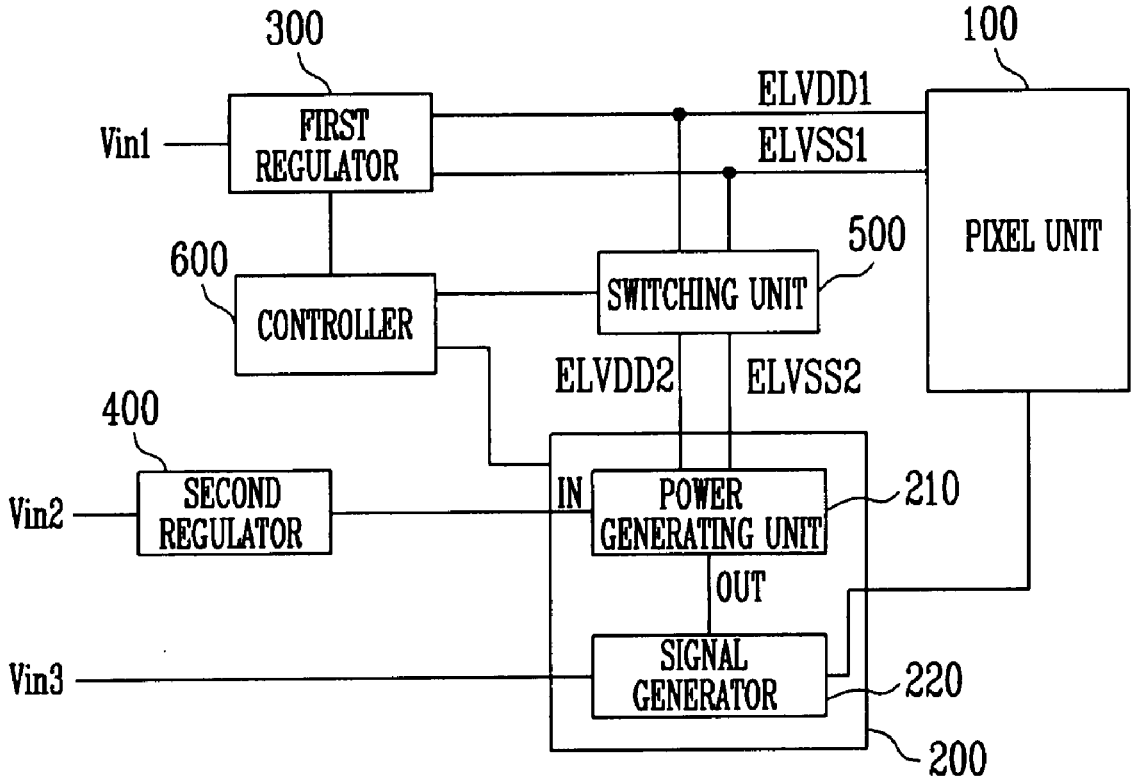
FIG. 1 is a block diagram view showing a structure of an organic electro-luminescence display.

FIG. 1 is a schematic view showing a structure of an organic electro-luminescence display. Referring to FIG. 1, an organic electro-luminescence display includes a pixel unit 100, a driver driving unit 200, a first regulator 300, a second regulator 400, a switching unit 500 and a controller 600.

The pixel unit 100 has a plurality of pixels, a plurality of data lines configured to transmit data signals to the pixels; a plurality of scan lines configured to transmit scan signals to the pixels; and a first pixel power source line and a second power source line configured to drive the pixels. Although the second pixel power source line is represented as a wire, it may be formed in one film to cover the whole of the pixel 100.

The driver driving unit 200 includes a power generating unit 210 and a signal generator 220, wherein the power generating unit 210 generates voltage to be used in the signal generator 220 and the signal generator 220 includes a data driver and a scan driver. The power generating unit 210 generates a plurality of voltages to transmit to the signal generator 220 so that the signal generator 220 receives optional voltages among the plurality of voltage generated from the power generating unit 210 to be driven. Also, the power generating unit 210 generates a power voltage ELVDD2 and a power voltage ELVSS2 and transmits the power voltage ELVDD2 and the power voltage ELVSS2 to the pixel unit 100 in a partial driving state or a standby mode state.

The data driver included in the signal generator 220 is connected to the plurality of data lines to transmit the data signals to the pixel unit 100. The scan driver included therein is connected to the plurality of scan lines to transmit the scan signals to the pixel unit 100.

In the case of a partial driving, the data driver generates data signals displaying black in a display portion outside of a predetermined region to transmit them to the pixel unit 100. The data driver also transmits the power voltage ELVDD2 and the power voltage ELVSS2 to the pixel unit 100. In the case of a standby mode, the power voltage ELVDD2 and the power voltage ELVSS2 are transmitted to the pixel unit 100, being not related to the operation of the data driver. Since the load of the pixel unit 100 is very small in a partial driving or a standby mode, the power sources for the power voltage ELVDD2 and the power voltage ELVSS2 do not need to supply large amounts of power, making it possible to use the power generated from the driver driving unit 200.

The first regulator 300 is a switching regulator, which is configured to generate a first power voltage ELVDD1 and a second power voltage ELVSS1 based on a power signal received from an external source to transmit to the pixel unit 100. The pixel unit 100 has large load due to the resistance component and the capacitor component in the plurality of pixels so that the first regulator 300 should be implemented with large power supplying capability.

The second regulator 400 is a low drop out (LDO), which is configured to generate driving power for the driver driving unit 200 based on a power signal received from an external source. The second regulator 400 has a beneficial power supply rejection ratio (PSRR) and therefore generates a small difference between the output voltage and the input voltage. The second regulator 400 drives the driver driving unit 200, making it possible for the driver driving unit 200 to be implemented with small power consumption.

The switching unit 500 blocks the power voltage ELVDD2 and the power voltage ELVSS2 generated from the power generating unit 210 when the power voltage ELVDD1 and the power voltage ELVSS1 are transmitted to the first regulator 300, and transmits the power voltage ELVDD2 and the power voltage ELVSS2 generated from the power generating unit 210 to the pixel unit 100 when the driving of the first regulator 300 is stopped.

The controller 600 controls the operations of the driver driving unit 200, the first regulator 300 and the switching unit 500, etc. and transmits the control signal controlling the driver driving unit 200. In a partial driving state or a standby mode state, the controller 600 stops the operation of the first regulator 300 and transmits the power voltage ELVDD2 and the power voltage ELVSS2 generated from the power generating unit 220 to the pixel unit 100 by controlling the switching operation of the switching unit 500.

Figure 2:
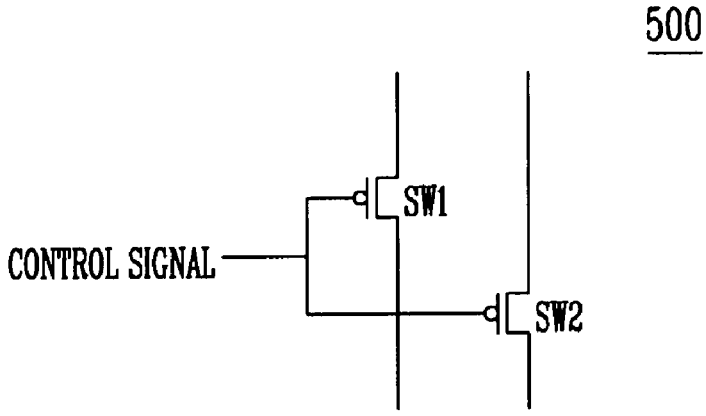
FIG. 2 is a schematic view showing a switching unit used in the organic electro-luminescence display as shown in FIG. 1.

FIG. 2 is a schematic view showing a switching unit 500 used in the organic electro-luminescence display as shown in FIG. 1. Referring to FIG. 2, a switching unit 500 includes first and second switches SW1 and SW2 configured to switch the third power voltage and the fourth power voltage input from the power generating unit 210 of the driver driving unit 200. The first and second switches SW1 and SW2 are configured to selectively switch the third and fourth power voltages based on the control signal.

The first terminal of the first input stage 510 is connected to an output terminal of the first regulator and the second terminal is connected to a power source line configured to transmit the first power voltage and the second power voltage to the pixel unit. The first input stage receives the first power voltage and the second power voltage from the first regulator to transmit them to the pixel unit.

The first terminal of the second input stage 520 is connected to the power generating unit 210 of the driver driving unit 200, and the second terminal is connected to a first pixel power source line and a second pixel power source line configured to transmit the first power voltage and the second power voltage of the pixel unit through the first switch SW1 and the second switch SW2. The second input stage 520 receives the third power voltage and the fourth power voltage from the power generating unit to transmit them to the pixel unit.

The first and the second switches SW1 and SW2, which perform a switching operation by receiving a control signal from a controller, are connected between the second input stage and the first pixel power source line and the second pixel power source line. And, the first and the second switches SW1 and SW2 become an on state when the operation of the first regulator is stopped, allowing the power voltage ELVDD2 and the power voltage ELVSS2 generated from a driver driving unit to be transmitted to the first pixel power source line and the second power source line through the second input stage 520. In some embodiments, if data input signals are not received by the display device for longer than a predetermined time, the pixel unit receives the third power voltage and the fourth power voltage through the pixel power source line.

Figure 3:
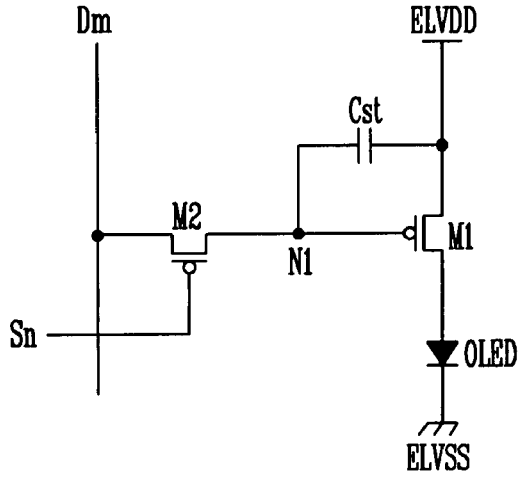
FIG. 3 is a schematic view showing a pixel used in the organic electro-luminescence display as shown in FIG. 1.

FIG. 3 is a circuit view showing a pixel used in the organic electro-luminescence display as shown in FIG. 1. Referring to FIG. 3, the pixel of an organic electro-luminescence display, which is connected to a data line Dm, a scan line Sn, a first power voltage ELVDD and a second power voltage ELVSS, includes an organic light-emitting diode OLED, a first transistor M1, a second transistor M2 and a capacitor Cst.

The organic light-emitting diode OLED includes an anode electrode, a light-emitting layer and a cathode electrode, and the light-emitting layer comprises a plurality of organic films between the anode electrode and the cathode electrode. If the first power voltage ELVDD having high voltage is connected to the anode electrode and the second power voltage ELVSS having voltage lower than the first power voltage ELVDD is connected to the cathode electrode, the current flows from the anode electrode to the cathode electrode so that the light is emitted in the light emitting layer corresponding to the amount of the current.

The first transistor M1, of which the source is connected to the first power voltage ELVDD, the drain is connected between the organic light-emitting diodes OLEDs, and the gate is connected to a first node N1, controls the amount of the current flowing from the anode to the cathode of the organic light-emitting diode OLED based on the voltage of the gate. In other words, the amount of the light-emission of the organic light-emitting diode OLED is controlled based on the voltage of the gate of the first transistor M1.

The second transistor M2, of which the source connected to the data line Dm, the drain is connected to a first node N1, and the gate is connected to the scan line Sn, is configured to transmit the data signal from the data line Dm to the first node N1 according to the scan line Sn signal.

The capacitor Cst is connected between the first node N1 and the first power voltage line ELVDD to maintain the voltage of the first node N1 during the period of a frame.

Figure 4:
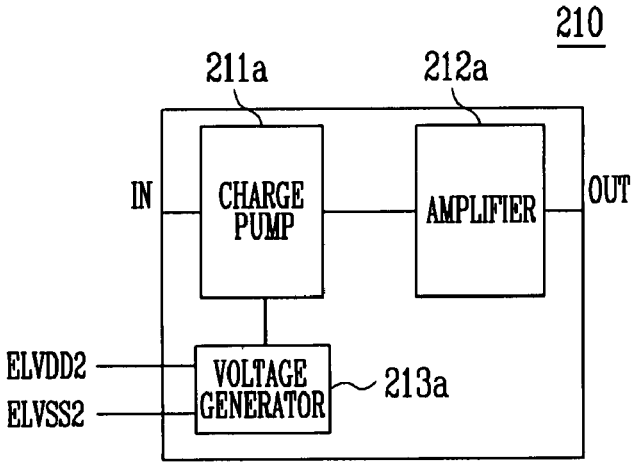
FIG. 4 is a structural view showing a first embodiment of a structure of the power generator as shown in FIG. 1.

FIG. 4 is a block diagram showing a first embodiment of a structure of the power generating unit 210 as shown in FIG. 1. Referring to FIG. 4, a power generating unit 210 includes a charge pump 211*a*, an amplifier 212*a* and a voltage generator 213*a*.

The charge pump 211*a*, which is capable of outputting voltage higher than an input voltage, boosts the input voltage by using a capacitor (not shown) to output multiple voltages through a plurality of output terminals.

The amplifier 212*a* amplifies the voltage from the charge pump 211*a* and transmits the amplified voltage to a signal generator of the driver driving unit so that the proper voltage for driving a data driver or a scan driver in the signal generator is generated.

The voltage generator 213*a* is connected to the charge pump 211*a* to boost the voltage output from the charge pump 211*a* and to generate a third power voltage ELVDD2 and a fourth power voltage ELVSS2. The voltage generator 213*a* may be a part of the charge pump 211*a*. In some embodiments, the output terminal of the charge pump 211*a* capable of outputting the third power voltage ELVDD2 and the fourth power voltage ELVSS2 of the charge pump 211*a* is separately referred to as the voltage generator 213*a*.

Figure 5:
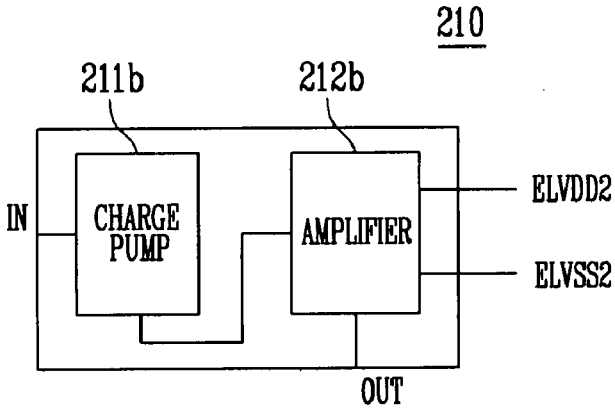
FIG. 5 is a block diagram showing a second embodiment of a structure of the power generator as shown in FIG. 1.

FIG. 5 is a block diagram showing another embodiment of a structure of the power generating unit 210 as shown in FIG. 1. Referring to FIG. 5, a power generating unit 210 includes a charge pump 211*b* and an amplifier 212*b*.

The charge pump 211*b*, which is capable of outputting voltage higher than input voltage, boosts the input voltage by using a capacitor (not shown) to output multiple voltages through a plurality of output terminals.

The amplifier 212*b* amplifies the voltage output from the charge pump 211*b* to transmit it to a signal generator of a driver driving unit so that voltage suitable for driving a data driver or a scan driver in the signal generator is generated and transmitted. Also, the amplifier 212*b* amplifies the voltage output from the charge pump 211*b* to generate a power voltage ELVDD2 and a power voltage ELVSS2. When the power voltage ELVDD2 and the power voltage ELVSS2 are generated in the charge pump 211*b*, there is risk of generating ripple in the output voltage. In particular, when the ripple occurs in the power voltage ELVDD2, there is risk of generating noise on the display screen. However, if the power voltage ELVDD2 and the power voltage ELVSS2 are generated by amplifying the signal output from the charge pump 211*b* by using the amplifier 212*b*, the voltage of the power voltage ELVDD2 and the power voltage ELVSS2 keeps constant, so that there is no ripple.

Figure 6:
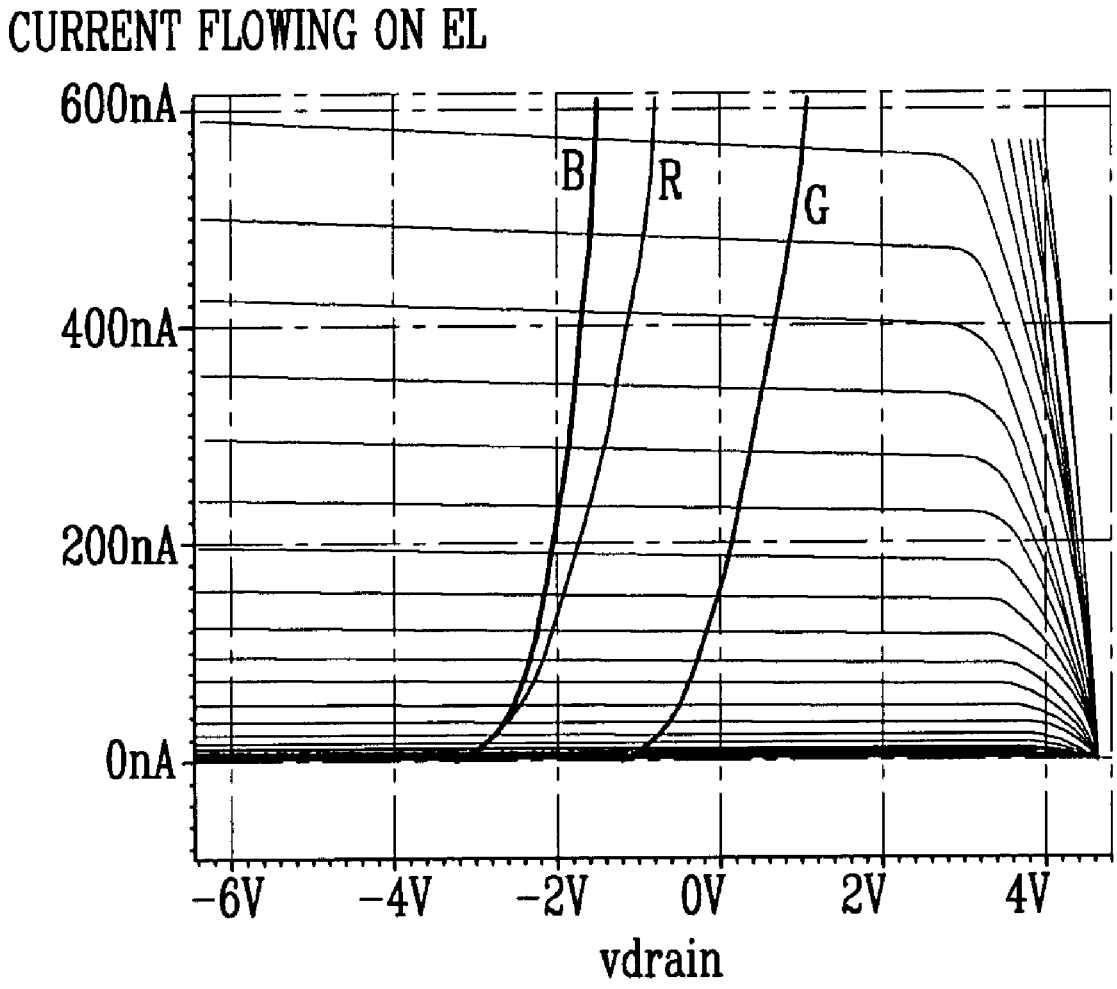
FIG. 6 is a graph showing a method to lower brightness in an organic electro-luminescence display.

FIG. 6 is a graph showing a characteristic curve of an organic light-emitting diode and a transistor in an organic electro-luminescence display according to some embodiments. Another aspect is a horizontal axis represents voltage of a drain electrode of a first transistor of the pixel as shown in FIG. 3, and a vertical axis represents the amount of current flowing on an organic light-emitting diode.

Referring to FIG. 6, as the voltage of the drain electrode of the first transistor lowers, the current flowing in the organic light-emitting diode representing red R, green G and blue B emission, reduces. Since the organic light-emitting diode represents brightness corresponding to the amount of the current, the brightness represented by the organic light-emitting diode lowers.

Therefore, the amount of the current flowing on the organic light-emitting diode becomes small in a partial driving state or a standby mode state, making it possible to reduce the power consumption of the organic electro-luminescence display.

If the power voltage transmitted through the second power source line is reduced, the voltage of the drain electrode of the first transistor reduces, making it possible to reduce the amount of the current flowing on the organic light-emitting diode. Also, the second power voltage output form the first regulator or the fourth power voltage outputted from the charge pump or the amplifier reduces, making it possible to reduce power consumption in a partial driving state or a standby mode state.

With an organic electro-luminescence display and a driving method thereof according to presented embodiments, the organic electro-luminescence display can reduce power consumption in a partial driving and a standby mode.

Although a few embodiments have been shown and described, it would be appreciated by those skilled in the art that changes might be made in these embodiments without departing from the principles and spirit of the invention.

What is claimed is:

1. An organic electro-luminescence display comprising:

a pixel unit comprising a pixel connected to a data line, a scan line, and first and second pixel power source lines, wherein the pixel comprises an electro-luminescent display element configured to emit light according to current from the first pixel power source line, through the electro-luminescent display element, and to the second pixel power source line, and wherein the pixel unit is configured to display at least a portion of an image;

a first regulator configured to receive a power signal from an external source and to generate a first power voltage and a second power voltage based at least in part on the received power signal, the second power voltage having electric potential lower than the first power voltage, the first regulator further configured to transmit the first and second power voltages to the pixel power source lines;

a second regulator configured to receive another power signal from another external source, to generate a predetermined voltage based at least in part on the received other power signal, and to transmit the predetermined voltage to a driver driving unit, the driver driving unit comprising:

a signal generator configured to generate a data signal and a scan signal, and to transmit the data signal and the scan signal to the data line and the scan line, respectively; and a power generating unit configured to generate another predetermined voltage, to transmit the other predetermined voltage to the signal generator, to generate a third power voltage, and to generate a fourth power voltage, the fourth power voltage having electrical potential lower than the third power voltage; and a switching unit configured to transmit the third power voltage and the fourth power voltage to the pixel power source lines when the first power voltage and the second power voltages are off.

2. The display according to claim 1, wherein the driver driving unit comprises at least one of a data driver configured to generate data signals and a scan driver configured to generate scan signals.

3. The display according to claim 1, wherein the power generating unit comprises a charge pump configured to output a predetermined voltage according to an input voltage and an amplifier configured to amplify the predetermined voltage and to generate the third and fourth power voltages.

4. The display according to claim 1, wherein the power generating unit comprises a charge pump configured to output a predetermined voltage according to an input voltage and an amplifier configured to amplify the predetermined voltage and to generate the third and fourth power voltages.

5. The display according to claim 1, wherein the driver driving unit is configured to use voltages transmitted to the signal generator as the third power voltage and the fourth power voltage.

6. The display according to claim 1, wherein the voltage difference between the third power voltage and the fourth power voltage output from the power generating unit is less than the voltage difference between the first power voltage and the second power voltage output from the first regulator, and the voltage levels of the first power voltage and the third power voltage are substantially the same.

7. The display according to claim 1, wherein the switching unit comprises a first switch switched according to a control signal and a second switch switched according to the control signal, wherein the first switch and the second switch are connected between the power generating unit and the power source lines to selectively transmit the third power voltage and the fourth power voltage to the pixel power source lines according to the control signals.

8. The display according to claim 7, wherein if the first regulator stops operating, the first switch and the second switch are configured to be turned on by the control signal.

9. The display according to claim 7, further comprising a controller configured to stop the operation of the first regulator during a partial driving operation or during a standby mode, and further configured to transmit the control signal to the switching unit.

10. The display according to claim 1, wherein the first regulator comprises a switching regulator.

11. The display according to claim 1, wherein the second regulator comprises an LDO.

12. The display according to claim 1, wherein if the pixel unit displays an image in a portion of a predetermined region, the third power voltage and the fourth power voltage are transmitted to the pixel unit through the pixel power source lines.

13. The display according to claim 1, wherein if input signals are not transmitted for longer than a predetermined time, the pixel unit receives the third power voltage and the fourth power voltage through the pixel power source lines.

14. An organic electro-luminescence display comprising:

a pixel unit configured to display an image with at least one pixel connected to a data line, a scan line and first and second pixel power source lines, wherein the pixel comprises an electro-luminescent display element configured to emit light according to current from the first pixel power source line, through the electro-luminescent display element, and to the second pixel power source line;

a power supply configured to generate a first power voltage and a second power voltage and to transmit the first and second power voltages to the pixel through the pixel power source lines; and a driver driving unit comprising:

a signal generator configured to generate a data signal and a scan signal, and a power generating unit configured to generate an operating voltage based on a received driving voltage, wherein the signal generator is connected to the data line and the scan line to transmit the data signal and the scan signal to the pixel, and the power generating unit is configured to generate a third power voltage and a fourth power voltage and to transmit the third and fourth power voltages to the pixel through the pixel power source lines, and wherein the third power voltage and the fourth power voltage are transmitted to the pixel when the power supplier is stopped.

15. The display according to claim 14, wherein the driver driving unit comprises at least one of a data driver configured to generate data signals and a scan driver configured to generate scan signals.

16. The display according to claim 14, wherein the power generating unit comprises a charge pump configured to output a predetermined voltage according to an input voltage and an amplifier configured to amplify the predetermined voltage and to generate the third and fourth power voltages.

17. The display according to claim 14, wherein the power generating unit comprises a charge pump configured to output a predetermined voltage according to an input voltage and an amplifier configured to amplify the predetermined voltage and to generate the third and fourth power voltages.

18. The display according to claim 14, wherein the driver driving unit is configured to use voltages transmitted to the signal generator as the third power voltage and the fourth power voltage.

19. The display according to claim 14, wherein the voltage difference between the third power voltage and the fourth power voltage is less than the voltage difference between the first power voltage and the second power voltage, and the voltage levels of the first power voltage and the third power voltage are substantially the same.

20. The display according to claim 14, further comprising a switching unit including a first switch switched according to a control signal and a second switch switched according to the control signal, wherein the first switch and the second switch are connected between the power generating unit and the power source lines to selectively transmit the third power voltage and the fourth power voltage to the pixel power source lines according to the control signals.

21. The display according to claim 20, further comprising a controller configured to stop the operation of the power supply during a partial driving operation or during a standby mode, and further configured to transmit the control signal to the switching unit.

22. The display according to claim 21, wherein if the power supply stops operating, the first switch and the second switch are configured to be turned on by the control signal.

23. The display according to claim 14, wherein the power supply comprises a switching regulator.

24. The display according to claim 14, wherein the power generating unit comprises an LDO.

25. The display according to claim 14, wherein if the pixel unit displays an image in a portion of a predetermined region, the third power voltage and the fourth power voltage are transmitted to the pixel unit through the pixel power source lines.

26. The display according to claim 14, wherein if input signals are not transmitted for longer than a predetermined time, the pixel unit receives the third power voltage and the fourth power voltage through the pixel power source lines.

27. A method of driving an organic electrode luminescence display configured to display an image with at least one pixel connected to a data line, a scan line and first and second power source lines, the method including:

generating a first power voltage and a second power voltage;

transmitting the first and second power voltages to the pixel through the first and second pixel power source lines, respectively;

displaying an image using the first power voltage and the second power voltage according to current from the first pixel power source line, through the pixel, and to the second pixel power source line;

ceasing to generate the first power voltage and the second power voltage in response to a control signal; and transmitting a third power voltage and a fourth power voltage according to the control signal to the pixel through the power source lines to display an image using the third power voltage and the fourth power voltage according to current from the first pixel power source line, through the pixel, and to the second pixel power source line.

28. The method according to claim 27, wherein if the organic electro-luminescence display is in a standby mode or a partial driving operation, the third power voltage and the fourth power voltage are transmitted to the pixel power source line according to the control signal.

* * * * *